US005238356A

United States Patent [19]

Salli

[11] Patent Number: 5,238,356

[45] Date of Patent: Aug. 24, 1993

[54] METHOD IN THE STORAGE AND COLLECTION OF WASTE AS WELL AS WASTE CONTAINER AND WASTE SACK OR A LIKE FOR CARRYING OUT THE METHOD

[76] Inventor: Veikko Salli, Niemikatu 2 A 26, SF-33230 Tampere, Finland

[21] Appl. No.: 634,193

[22] PCT Filed: Jul. 18, 1989

[86] PCT No.: PCT/FI89/00135

§ 371 Date: Jan. 17, 1991

§ 102(e) Date: Jan. 17, 1991

[87] PCT Pub. No.: WO90/01008

PCT Pub. Date: Feb. 8, 1990

[30] Foreign Application Priority Data

Jul. 20, 1988 [FI] Finland ..... 883428

[51] Int. Cl.[5] ..... B65F 1/06

[52] U.S. Cl. ..... 414/403; 220/484; 220/908; 220/408; 220/DIG. 9; 220/415; 222/179.5

[58] Field of Search ..... 414/403, 404, 407, 411, 414/414, 408, 422, 786, 607; 405/128, 129; 222/105, 179.5, 181, 185; 220/408, 484, 908, 23, 83, 1.5, DIG. 9, 415

[56] References Cited

U.S. PATENT DOCUMENTS

| | | | |
|---|---|---|---|
| 502,595 | 8/1893 | St. George | 220/484 |
| 3,028,895 | 11/1959 | Gooding | 150/1 |
| 3,675,810 | 7/1972 | Ross, Jr. et al. | 220/908 X |
| 3,837,521 | 9/1974 | Huston et al. | 220/484 X |
| 4,457,456 | 7/1984 | Derby et al. | 222/105 |
| 4,479,243 | 10/1984 | Derby et al. | 383/24 |
| 4,917,263 | 4/1990 | Korb | 220/908 X |

FOREIGN PATENT DOCUMENTS

| | | | |
|---|---|---|---|
| 83505 | 12/1982 | European Pat. Off. . | |
| 1927557 | 6/1970 | Fed. Rep. of Germany . | |
| 1948212 | 1/1972 | Fed. Rep. of Germany . | |
| 2804954 | 8/1979 | Fed. Rep. of Germany | 414/403 |
| 47172 | 12/1970 | Finland . | |
| 1322899 | 2/1962 | France . | |
| 224627 | 1/1969 | Sweden . | |

*Primary Examiner*—Frank E. Werner

*Attorney, Agent, or Firm*—Burns, Doane, Swecker & Mathis

[57] ABSTRACT

The method for storing and collecting waste employs periodically emptied waste containers. Waste is stored in a storage space included in the waste container, namely in a reusable subcontainer such as a sack, is picked up from the storage space during the collection and unloaded. A waste container for carrying out the method comprises a storage space for storing waste. The storage space is provided with a reusable subcontainer, such as a sack, for storing waste, and the subcontainer is removable from the storage space. The bottom of the subcontainer is provided with an openable and closable hole for emptying the contents of the subcontainer.

3 Claims, 3 Drawing Sheets

Figure 1:
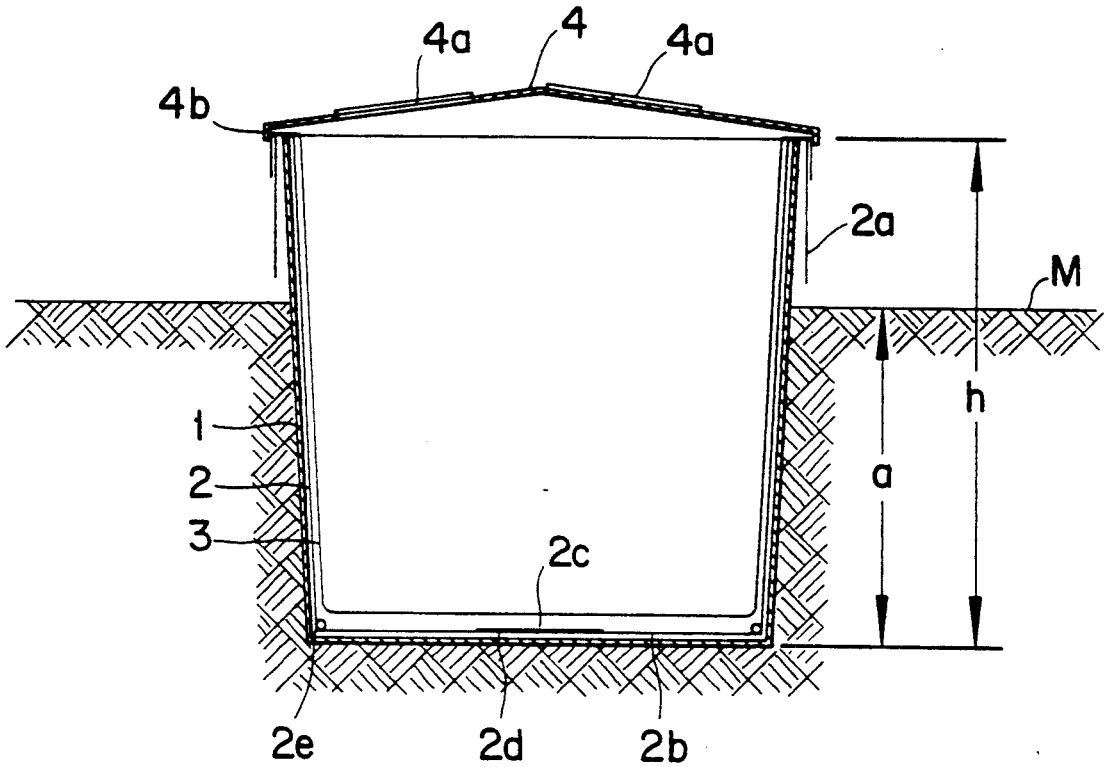

Fig. 3
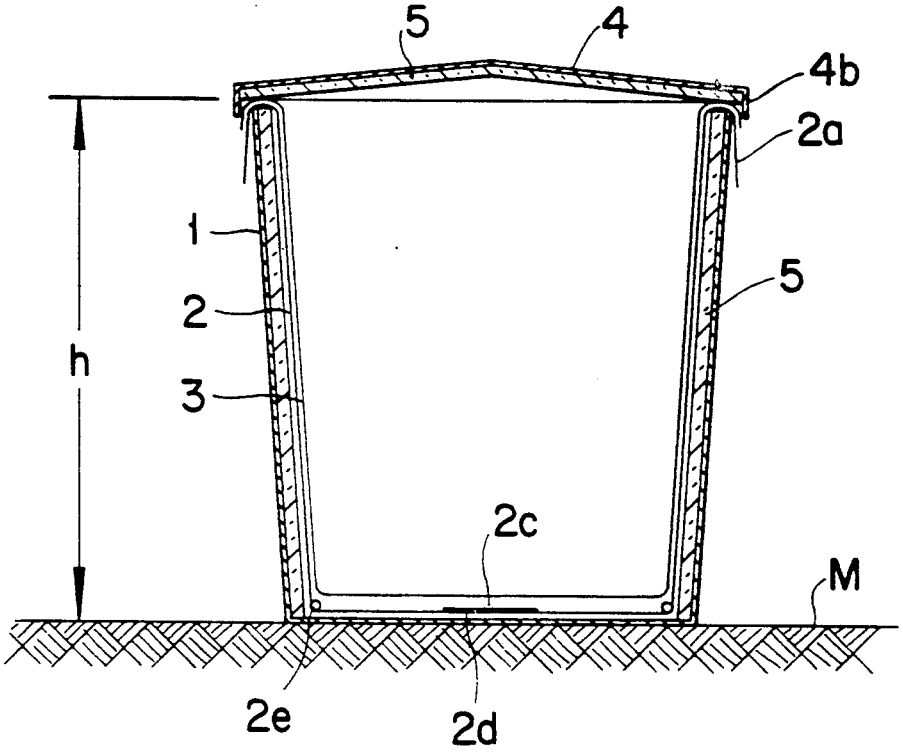
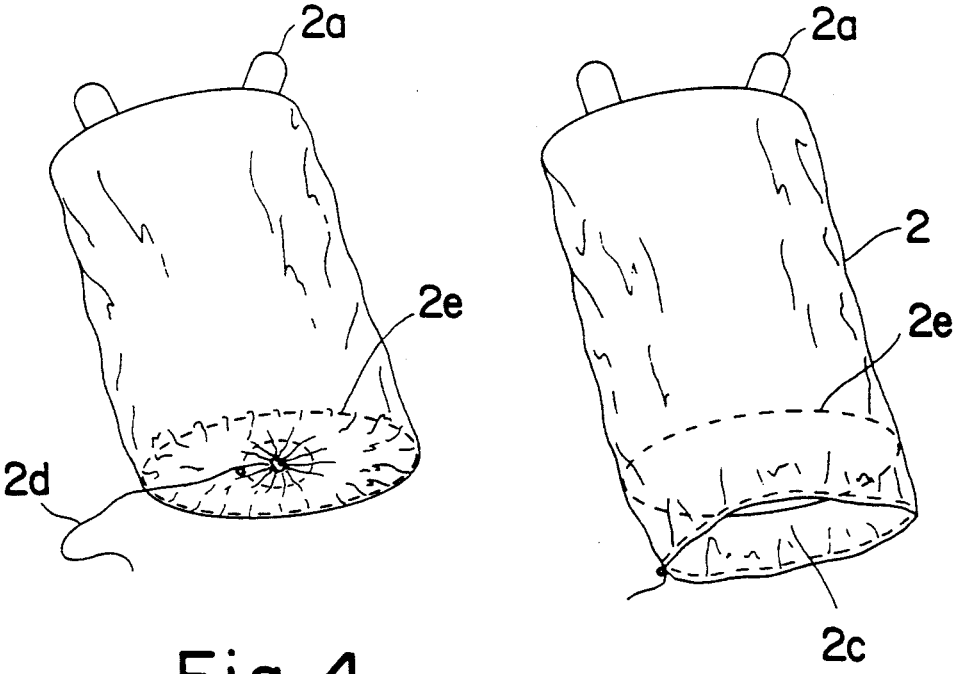
Fig. 4

METHOD IN THE STORAGE AND COLLECTION OF WASTE AS WELL AS WASTE CONTAINER AND WASTE SACK OR A LIKE FOR CARRYING OUT THE METHOD

The present invention relates to a method for the storage and collection of waste employing periodically emptied waste containers. The invention relates also to a waste container and a waste sack or a like for carrying out the method.

The current garbage collection systems in Finland and also in other countires are primarily based on the interchangeable platform type of collection or on smaller garbage containers which are either unloaded e.g. into a hydraulic garbage truck or carried to a dump for unloading. In Finland, for example, the interchangeable platform based garbage or waste collection is quite general. In the interchangeable platform system, the investments on a platform are substantial, at present circa FIM 20.000 in Finland. In addition, the system takes a lot of space since the working area required in the yard is approximately 100 $m^2$. The garbage container has a volume of circa 10 $m^3$ and is only filled by about 60% due to its low design. In addition, the container is non-hygienic since some of the waste sacks are always broken or become damaged in handling. The waste collection unit is an interchangeable platform truck, whereby the unloading of an interchangeable platform along with driving and handling to a dump e.g. 15 km away takes about an hour, i.e. the handling efficiency will be 6 $m^3$ waste/h Thus, the calculated waste handing cost will be FIM 45/$m^3$ waste.

An object of the invention is to eliminate the above drawbacks and to provide a method that is more practical and economic than the above-described system in the storage and collection of waste as well as a novel type of waste container for carrying out the method. In order to achieve the above objects, a method of the invention is principally characterized in that waste or garbage is stored in the storage space of a waste container in a reusable subcontainer, such as a sack, placed in the storage space and picked up from the storage space for collection and dumping. A subcontainer, such as a sack, facilitates considerably the collection work and during collection it is removed from the storage space and unloaded either at the same instance into a waste collection unit or subsequently on the dumping ground. In the former case, the subcontainer can be replaced at the same time in the storage space after being unloaded into a waste collection unit, and in the latter case, the subcontainer is transferred along with its contents into a waste collection unit to be carried to a dump and a fresh subcontainer is at the same time substituted for the removed one in the storage space.

According to one preferred embodiment of the invention, the need for space is substantially reduced by burying the waste container underground. In addition, the waste storage space can be readily unloaded by several alternative methods. Furthermore, the waste will not be exposed to hot summertime weather with increased odour problems since, for the most part, the waste lies underground where temperature is lower.

A waste container for embodying the invention is principally characterized in that the storage space of a waste container is provided with a reusable subcontainer, such as a sack, for waste storage, said subcontainer being removable from the storage space for unloading. According to one preferred embodiment, the storage space is buried underground and may be provided with walls extending aboveground and having their upper rim support a cover or a lid for closing the storage space. By virtue of this arrangement, the waste containers are clearly visible in environment and, for example, children cannot work their way into the container. The storage and unloading of waste are considerably facilitated by a subcontainer, fitted inside the storage space and removable therefrom. In addition, there are structural options for performing the pick-up of a subcontainer and the dumping of its contents.

By means of a waste sack of the invention, the above subcontainer concept can be realized in a practical manner.

Figure 2:
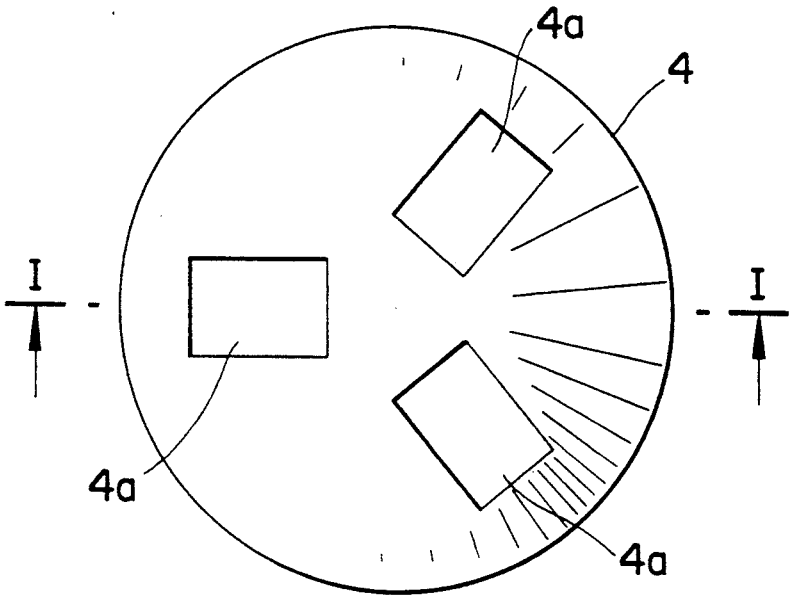
Figure 5:
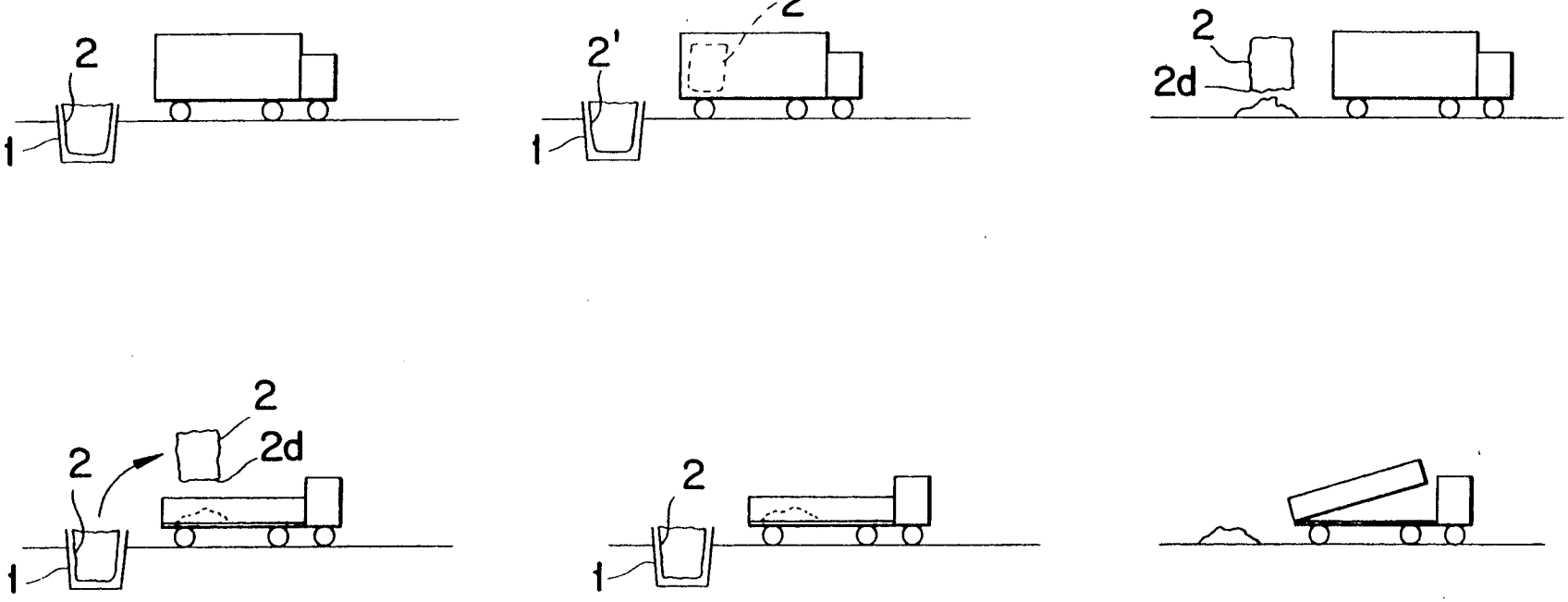

The invention will now be described in more detail with reference made to the accompanying drawings, in which FIG. 1 shows a waste container of the invention in a side view and in a vertical section, FIG. 2 shows the container of FIG. 1 in a plan view and FIG. 3 shows one alternative embodiment of a waste container, FIG. 4 shows one practical embodiment of a waste sack of the invention and FIG. 5 is a schematic representation of a method of the invention.

FIG. 1 shows a waste container of the invention having its storage space 1 buried beneath ground level M or the like. Such a level can be thought to include all surfaces for dropping waste into a container and, respectively, to effect the unloading of a container. The walls of storage space 1 consist of a vertical, close-bottomed and open-topped cylindrical container 1 made of steel or some other material, such as reinforced plastics. The container is preferably buried in the ground in a pit dug therefor in a manner that the majority of a container volume lies beneath the ground M. The side walls of a container extend in the top section of a container above the ground M as a side wall 1*a*, whose upper rim supports a circular cover or lid 4 which closes the storage space from above and can also be made of steel or some other material, such as reinforced plastics.

The cross-sectional area of container 1 increases upwards in horizontal plane, i.e. the container is slightly expanding conically upwards, which facilitates the pick-up of waste from the container. In horizontal cross-section, the container may have a different, e.g. square shape.

According to the invention, inside said storage space 1 is fitted a subcontainer 2 for picking up the waste out of storage space 1 during collection. The subcontainer 2 can be e.g. a sack or a bag made of a sufficiently strong flexible material, e.g. nylon fabric, said sack conforming to the side walls and bottom of container 1. The upper rims of the sack are flush with side walls 1*a* and are at this point folded outside the rim having loops 2*a* fastened to the upper rim of sack 2 hanging therefrom. These loops can be used to lift sack 2 along with its contents out of the container. In the bottom section of sack 2 at the junction of the side walls and bottom of container 1 there extends a circular band 2*e* for giving sack 2 the shape matching that of the interior of container 1, i.e. principally for spreading the bottom of sack 2 sufficiently wide. In addition, the bottom 2*b* of sack 2 is provided with an openable and closable hole 2*c*. The hole 2*c* is surrounded by a loop 2*d* formed by a rope or a corresponding elongated member whose length can be varied for opening and closing said hole 2c on a so-called gathering string principle.

FIG. 1 shows further an open-topped disposable sack 3 which is placed inside sack 2 and which can be made e.g. of plastics or paper, generally some inexpensive disposable material, e.g. waste plastics. Sack 3 lies against the inner surface of sack 2 in the container and it is open-topped in a manner that its top rim is folded the same way as that of sack 2 on top of side wall 1a and outside the wall. The actual waste is placed in the internal space provided by this sack 3.

The assembly formed by container 1 and sacks 2 and 3 is closed at the top by a removable cover 4 which, as shown in FIG. 2, is circular and has its outer rims on top of the upper rim of the side wall 1a of container 1 for simultaneously holding the outwardly folded upper rims of sacks 2 and 3 in position. The position of cover 4 in lateral direction is further secured by means of a collar flange 4b which lies on the outside and extends downwards. In addition, the central portion of cover 4 extends higher than the peripheral sections to prevent rainwater from gathering on top of the cover. The cover is provided with one or a plurality of filling gates 4a for dropping waste into storage space 1. In addition, the storage space is tightly sealed at least in its bottom to prevent the fluids possibly spilling from waste inside the container from trickling into the soil.

The internal diameter of cylinder 1 in horizontal plane is e.g. 500–2500 mm. The shape of a container may naturally vary. The burying depth a, i.e. the distance of the bottom of container 1 from the ground M is preferably circa 1700 mm. The overall height h of container 1 is preferably circa 2500 mm, i.e. side wall 1a extending above the ground M has a height of circa 800 mm. Of course, the burying depth can also vary but the bulk of the total volume of container 1 lies preferably under the ground M or the burying depth is such that the bulk of a space for storing the waste lies under the ground M. For example, a container such as that shown in FIG. 1 can be emptied whenever the amount of waste in the container increases such that its upper surface rises above the ground M.

FIG. 3 shows one alternative position for a waste container. In this case, a container 1 is placed entirely aboveground and it contains an auxiliary sack 2 acting the same way as the subcontainer in FIG. 1. The dimensions (height, width) can be the same as above with ladders or some other accessories being provided adjacent to high containers. If such a container is desired that the waste can be dropped therein without accessories, it is obvious that in this case the maximum container height h does not equal that of the case shown in FIG. 1. Thus, the height can be e.g. 1200 mm and the internal diameter circa 800 mm. In addition, the walls and cover of a waste container can be lined with a heat insulator, designated in FIG. 3 with reference numeral 5.

The unloading of a waste container is effected as follows: A cover 4, which is a removable element, is lifted aside e.g. manually or by means of the actuators of garbage truck. Then, the sack 2 serving as a subcontainer is picked up by means of loops 2a onto the platform of a garbage truck in a space reserved therefor which supports the sack during transport. This is followed by placing in the emptied container 1 a fresh sack 2' having a disposable sack inside it. This procedure is illustrated in a chart shown in FIG. 5. Depending on the size of containers, the garbage truck may accommodate 3–10 sacks, whereafter the truck carries the load to a dump. At the dump, sack 2 is lifted up and loop 2d surrounding a hole 2c in its bottom is released, whereby the sack bottom 2b spreads to extend parallel to the sack side walls and to form a hole 2c through which said disposable sack 3 falls down. Thereafter, the bottom of sack 2 can be reclosed with loop 2d and sack 2 is again ready for use.

In one alternative method, sack 2 is emptied onto the platform of a garbage truck as soon as it has been lifted out of container 1. This is followed by reclosing and replacing the same sack 2 back in the same container 1. This method is also shown in FIG. 5.

FIG. 4 shows in more detail a subcontainer of the invention and its operating principle. Subcontainers 2 are prepared in the form of a sack by using a sufficiently strong, flexible material, including e.g. nylon fabric or web. The sack is open at the top and its mouth is bordered by loops 2a for moving the sack about. In principle, the sack is open also at the bottom but there is a string 2d threaded along the lower rim for providing a loop around the bottom mouth 2c whereby said hole 2c can be closed and opened. The string can be fitted with any clamping means at all for keeping the loop tight and for opening the hole by releasing it. In addition, FIG. 4 shows a rigid band 2e which is sewn or otherwise fastened to the inner sack surface and which is located between the sack mouth and discharge hole 2c. The band serves as a reinforcement and expands the sack bottom section sufficiently wide. In practice, the sack can be manufactured e.g. of a tubular blank of material whose ends form the mouth and discharge hole 2c.

A system of the invention provides savings both in terms of costs and time spent for handling waste. For example, a container with a diameter of 2,5 m has a total volume of circa 11 $m^3$ that can be filled up to about 90%. The garbage truck will be able to empty three such waste containers on a single run and the time spent is about 1,5 h. Thus, the handling efficiency will be approximately 20 $m^3$ of waste/h. An estimated single investment on one container and its cover would be circa FIM 7.000 and, thus, the costs of handling would be about FIM 15/$m^3$ waste. In addition, the operational area required by the method would be just circa 20 $m^2$.

The above description is by no means intended to restrict the invention to those particular embodiments but it can be varied within the scope of an inventive concept set forth in the claims. A waste container 1 is preferably tight or sealed at least for its parts below the ground M to prevent water from entering the interior defined by container 1. It is also conceivable that container 1 would be permeable to water for its parts below the ground M but sufficiently rigid only to prevent the trickling of solid earth material into the interior defined by container 1, in which case a subcontainer 2 should be sufficiently sealed and impermeable to water. After all, the decisive factor concerning the design of a container is the environment, e.g. the level of ground water. In the above example, the subcontainer 2 is in the form of a flexible sack 2 but a rigid container can also be used as such. When such a container is to be emptied on a gathering string or drawband principle, its bottom should in this case be made of a flexible material. A conceivable subcontainer 2 could also be a web-like structure which holds therein a disposable plastic bag or sack 3. It should be further appreciated that a disposable sack 3 is not necessarily required but waste can be just as well stored and carried as such in a subcontainer 2 provided it is sufficiently tight but, in view of keeping the latter clean, the use of a disposable sack 3 is preferred. It should also be appreciated that in containers, which are relatively wide, can be accommodated vertically side by side two or more subcontainers 2. In addition, the shape of a container is by no means restricted to circular in horizontal section but the container and its cover can be of other shapes as well, e.g. square-shaped.

In the embodiment of FIG. 1, a cover 4 can be entirely removed but it can also made pivotable on hinges. The cover can be further provided with lifting hooks, not shown in the drawings, for facilitating the lifting action.

A method of the invention as well as containers used therein are suitable for handling of such communal waste like household waste which heretofore has been handled by means of an interexchangeable platform system. The type of waste permitting, the method can also be applied to industrial waste service as well.

I claim:

1. A waste container for the storage and collection of waste, comprising a storage space, said storage space being defined by a side wall that has an open end and an upper rim adjacent the open end, a cover for closing the open end of the storage space, said cover being supported on the upper rim of the side wall, said storage space being provided with a reusable subcontainer for storing waste, said subcontainer being removably positioned within the storage space and said storage space having upper and lower parts, the lower part of said storage space being located below ground level and the upper part of said storage space extending above the ground level, said subcontainer within said storage space being provided with an open top positioned below said cover, said subcontainer having a bottom at which is provided an openable and closable hole for discharging waste stored in the subcontainer, the bottom of the subcontainer being located in said lower part of the storage space, and an open topped disposable sack positioned in said subcontainer so that waste can be positioned in said disposable sack.

2. A waste container according to claim 1, wherein said open-topped disposable sack has an upper portion that is folded outwardly over the rim of the side wall defining the storage space.

3. A waste container for the storage and collection of waste, comprising a storage space, said storage space being defined by a side wall that has an open end and an upper rim adjacent the open end, a cover for closing the open end of the storage space, said cover being supported on the upper rim of the side wall, said storage space being provided with a reusable subcontainer for storing waste, said subcontainer being removably positioned within the storage space and said storage space having upper and lower parts, the lower part of said storage space being located below ground level and the upper part of said storage space extending above the ground level, said subcontainer within said storage space being provided with an open top positioned below said cover, said subcontainer having a bottom at which is provided an openable and closable hole for discharging waste stored in the subcontainer, the bottom of the subcontainer being located in said lower part of the storage space, wherein at least a portion of the side wall of the storage space extending above the ground level is lined with a heat insulator.

* * * * *